US007115048B2

(12) United States Patent
Kusumoto et al.

(10) Patent No.: US 7,115,048 B2
(45) Date of Patent: Oct. 3, 2006

(54) IRON HEAD FOR A GOLF CLUB

(75) Inventors: Harunobu Kusumoto, Tokorozawa (JP); Atsushi Iijima, Tokorozawa (JP)

(73) Assignee: Daiwa Seiko, Inc., Tokyo (JP)

( * ) Notice: Subject to any disclaimer, the term of this patent is extended or adjusted under 35 U.S.C. 154(b) by 116 days.

(21) Appl. No.: 10/664,445

(22) Filed: Sep. 17, 2003

(65) Prior Publication Data

US 2004/0058746 A1 Mar. 25, 2004

(30) Foreign Application Priority Data

Sep. 19, 2002 (JP) ..... P2002-273314

(51) Int. Cl.
*A63B 53/04* (2006.01)

(52) U.S. Cl. ..... 473/342; 473/345; 473/350

(58) Field of Classification Search ..... 473/305–350
See application file for complete search history.

(56) References Cited

U.S. PATENT DOCUMENTS 4,252,262 A * 2/1981 Igarashi ..... 228/174
4,398,965 A * 8/1983 Campau ..... 148/522
5,255,918 A * 10/1993 Anderson et al. ..... 473/330
5,766,092 A * 6/1998 Mimeur et al. ..... 473/329
6,179,726 B1 * 1/2001 Satoh et al. ..... 473/290
6,383,090 B1 * 5/2002 O'Doherty et al. ..... 473/329
6,565,452 B1 * 5/2003 Helmstetter et al. ..... 473/342

* cited by examiner

*Primary Examiner*—Eugene Kim
*Assistant Examiner*—Alvin A. Hunter, Jr.
(74) *Attorney, Agent, or Firm*—Ditthavong & Mori, P.C.

(57) ABSTRACT

An iron head for a golf club having a metallic head body provided with a hosel part and a plate-like face body welded to the head body and made of a metallic material different from the metal of the head body so as to define a cavity between the back portion of the head body and the rear face of the face body in a manner such that the cavity extends to a position remote from the periphery of the face body located on the side of the heel of the head body toward the heel, and that a receipt portion of the head body provided for receiving the rear face of the face body on the heel side has a length thereof extending along the periphery of the face body on the heel side and being equal to or less than one forth of the length of the periphery of the face body on the heel side.

19 Claims, 4 Drawing Sheets

IRON HEAD FOR A GOLF CLUB

BACKGROUND OF THE INVENTION

1. Field of the Invention

The present invention relates generally to a golf club, and more particularly to an iron head for the golf club.

2. Description of the Related Art

A golf club head, especially an iron head has recently been provided without integrally producing the whole thereof but mounting, on a metallic head body, a plate-like face body made of a metallic material different from the metal of the head body, while connecting these two bodies together by welding so as to acquire an integral iron head, for achieving various purposes such as lowering of the manufacturing cost of the iron head, an easier manufacture thereof, widening of the sweet area of the iron head, and lengthening of the driving distance thereof. Typical examples of such conventional iron head are disclosed in Japanese Unexamined Patent Publication(Kokai) No.2001-246030.

Nevertheless, when a construction is adopted such that the rear face of the peripheral portion of the plate-like face body is received by the head body, to obtain an integral iron head, the face body is apt to be rigidly held by the head body, and as a result, a difficulty occurs such that the peripheral portion of the plate-like face body must suffer from lack of its bending ability when the face body hits a ball, to result in reduction in the rebound performance of the face body against the ball. In order to maintain a good rebound performance of the face body even when the hitting of a ball occurs at a position which is deviated from the sweet spot, namely, in order to increase the sweet area of the head as large as possible, it is requested that an area of the plate-like face body which lacks the bending ability is reduced to the possible smallest state, and that the size of the plate-like face body itself is increased. However, especially, since the hosel part is connected to the heel part of the iron head, there is necessarily a limit in either elongating or extending of the peripheral portion of the heel side of the plate-like face body.

SUMMARY OF THE INVENTION

Therefore, an object of the present invention is to provide an iron head being able to exhibit the best possible rebound performance thereof even when hitting of ball by the iron head occurs at a point adjacent to the periphery of the heel side of a plate-like face body.

In accordance with the present invention, there is provided an iron head for a golf club, which includes a head body made of a metal and having a hosel part, and a plate-like face body welded to the head body and made of a metallic material different from the metal of the head body, and which comprises a means for defining a cavity portion between the plate-like face body and a back part of the head body, the said cavity portion being defined so as to extend to a position remote from a periphery of the plate-like face body located on the heel side toward the heel of the head body, and further, a receipt portion of the head body for receiving a rear face of the plate-like face body on the heel side having a length thereof extending along the periphery of the plate-like face body on the heel side and being equal to or less than one forth of a length of the periphery of the plate-like face body on the heel side.

There may be included a case where the means for defining the cavity between the plate-like face body and the back part of the head body permits the cavity to be fluidly communicated with the external atmosphere through a through-hole formed in the back part of the head body. In order to intendedly provide such a construction that a major portion of the rear face of the periphery of the plate-like face body on the heel side is not received by the head body, the length of the receipt portion of the head body extending along the periphery of the plate-like face body on the heel side is defined to be equal to or less than one fourth of the length of the periphery of the plate-like face body on the heelside. This definition may permit inclusion of a case where the head body may be provided with an actual partial receipt portion thereof capable of practically receiving the rear face of the plate-like face body. In this case, however, when the length of the periphery of the face body on the heel side is defined as "L", the actual partial receipt portions of the head body should have the total length that is at most equal to or less than one fourth of "L", and should preferably be equal to or less than one fifth of "L". Further preferably, there should not exist any such actual receipt portion in the head body.

Since the rear face of the plate-like face body on the heel side is not mostly received by the head body, i.e., since at most one fourth of the rear face on the heel side is received by the head body, and further since the above-defined cavity portion is provided so as to extend to the position remote from the periphery of the plate-like face body on the heel side toward the heel of the head body, when the hitting of a ball occurs at a position adjacent to the periphery of the plate-like face body on the heel side, a region of the plate-like face body adjacent to the periphery thereof on the heel side will be easily bended or flexed, and accordingly, it is possible to acquire shots with a large force.

Preferably, the plate-like face body is made of a metallic rolled plate, which has a higher strength than that of a metal of which the head body is made.

Further preferably, the metallic rolled plate of the higher strength is made of a β type titanium alloy or a marageing steel.

Preferably, the plate-like face body and the head body are connected together by welding using laser-beam.

The employment of the laser-beam welding which does not need any welding rod or electrode provides such an advantage that the portion welded by the laser-beam could not usually be thickened so that the face body may be prevented from being inhibited from bending. Furthermore, any provision of thermal effect provided by the laser-beam welding on the welded portion can be small to thereby reduce lowering of strength of both of the face and head bodies around the welded portion. In addition, it is possible to suppress any thermal deformation which might occur between the hosel part and the face part of the iron head, and accordingly, the iron head with stable quality can be produced.

Further preferably, the periphery of the plate-like face body on the heel side is located to be in no contact with a ball when the ball comes into contact with a specified portion of the iron head, which extends between the face surface of the iron head and the surface of the heel part of the iron head, during shots by the iron head. Thus, the welded portion of the face and head bodies can be prevented from being directly hit by the golf ball, and accordingly the durability of the welded portion can be maintained.

Preferably, the cavity portion extending between a rear face of the plate-like face body and a back part of the head body is formed to be fluidly communicated with a shaft receipt hole provided in the hosel part of the iron head. It should be understood that the fluid communication between the cavity portion and the shaft receipt hole could contribute to reduction in the weight of the iron head. Furthermore, if it is assumed that the weight of the iron head is maintained constant, any metallic material removed from the above-mentioned extended cavity portion may be distributed to the circumferential portion of the iron head to thereby broaden its sweet area. Therefore, it is possible to stabilize shots.

Further preferably, the plate-like face body is arranged to extend over the entire width of the head body in the vertical direction. It should be understood that if the face body is vertical direction, the bendable area of the face body, i.e., a free region of the face body that is not received by the head body can be increased, and as a result, the rebound performance of the iron head is enhanced.

Further preferably, the thickness of the heel part of the head body at its portion confronting an end face of the periphery of the plate-like face body on the heel side is made larger than that of the face body.

Although the mechanical strength of the material of which the head body is produced is usually lower than that of the material of which the plate-like face body is produced, the thickened construction of the portion of the head body in this case can supplement the mechanical strength of the head body.

Preferably, the plate-like face body is made of marageing steel, and the head body is made of seventeen-four stainless steel containing 17% chromium, 4% nickel, 4% copper, and 1% niobium.

In this case, although the mechanical strength of seventeen-four stainless steel is lower than that of marageing steel, the above-described thickened construction of the portion of the head body can supplement the mechanical strength of the head body.

Most preferably, the thickness of the above-mentioned portion of the heel part of the head body made of seventeen-four stainless steel is made approximately 0.2 through 1 mm larger than that of the plate-like face body made of marageing steel.

BRIEF DESCRIPTION OF THE DRAWINGS

The above and other objects, features, and advantages of the present invention will become more apparent to those skilled in the art from the ensuing description of the preferred embodiments of the present invention, taken in conjunction with the accompanying drawings wherein.

DESCRIPTION OF THE PREFERRED EMBODIMENTS

Figure 1:
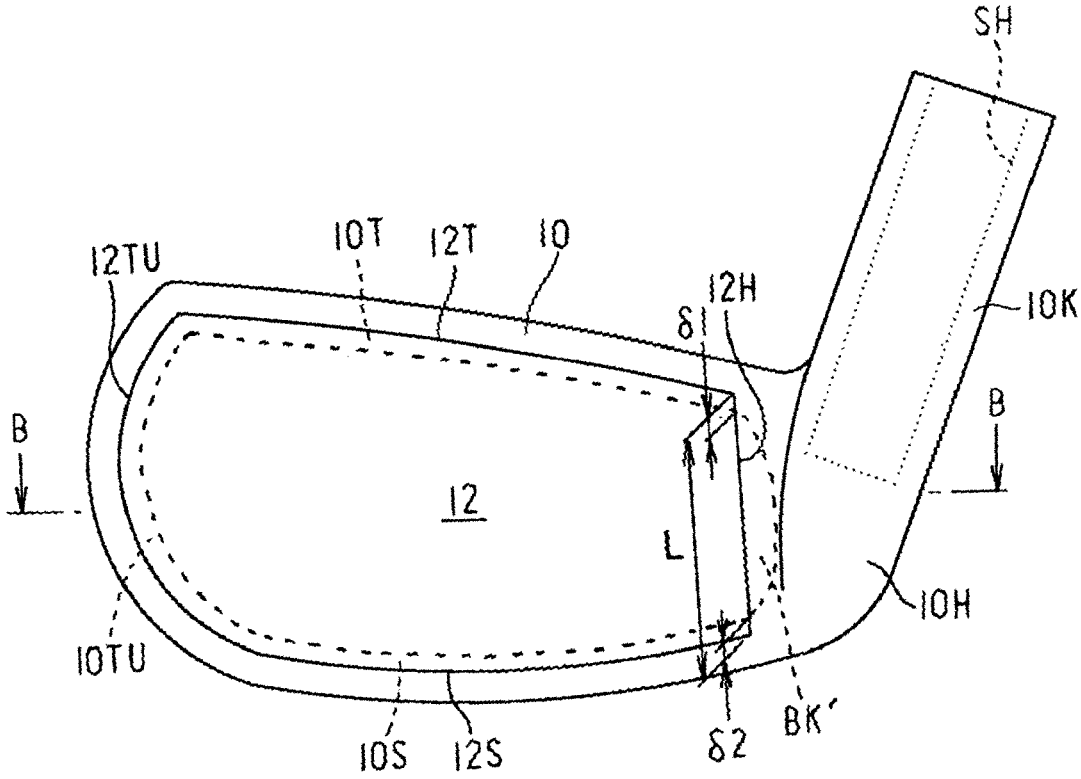
FIG. 1 is a front view of an iron head according to an embodiment of the present invention.
Figure 2:
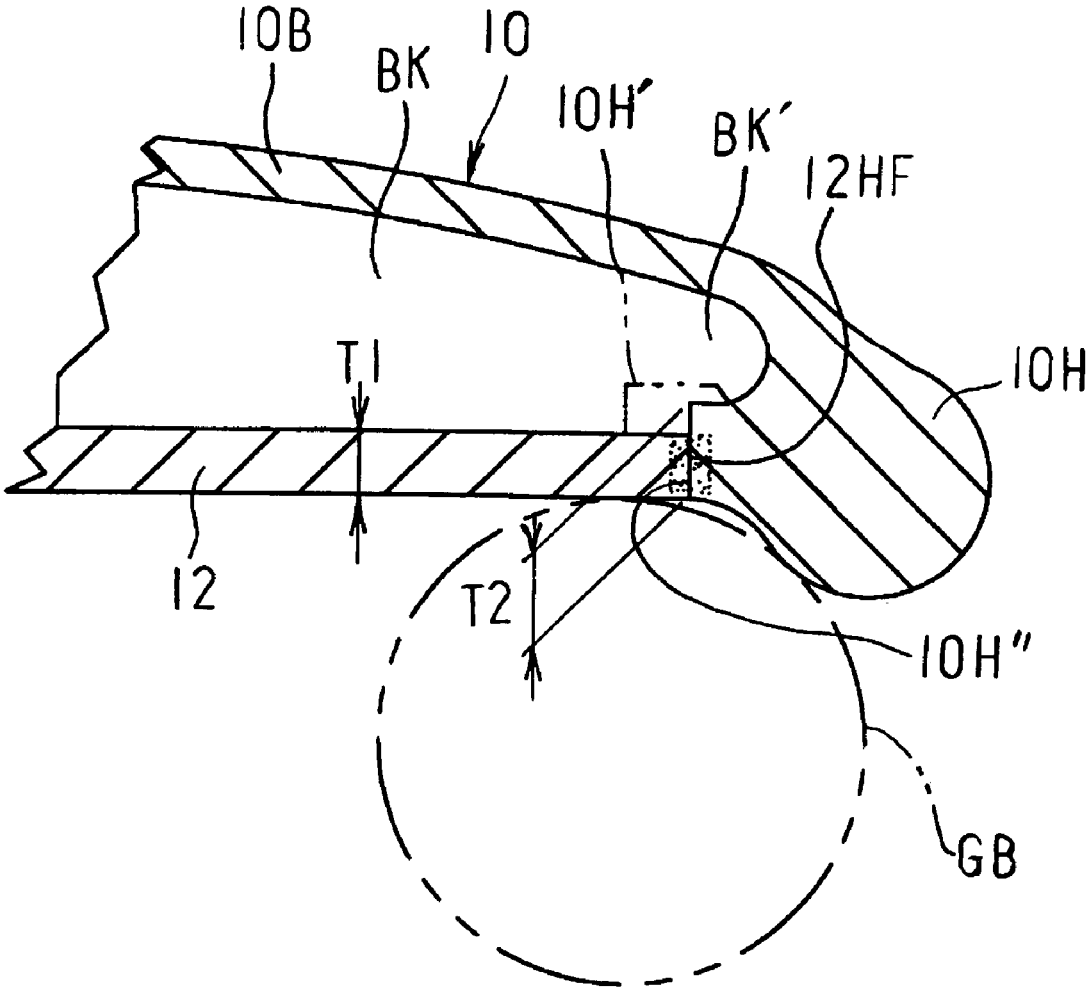
FIG. 2 is a partial cross-sectional view, taken along the line B—B of FIG. 1.

Referring to FIGS. 1 and 2, an iron head according to the present embodiment of the present invention is basically formed of two constituents, i.e., a head body 10 and a plate-like face body 12. The head body 10 is integrally provided, on the side of the heel part 10H, with a hosel part 10K having a receipt hole SH for permitting a shaft to be inserted therein. The head body 10 is made of a metallic material such as, for example, titanium, 6Al—4V titanium alloy, or seventeen-four (17-4) stainless steel containing 17% chromium, 4% nickel, 4% copper, and 1% niobium, and is produced by casting.

On the other hand, the plate-like face body 12 is made of a metallic material different from that of the head body 10, and the metallic material of the face body 12 maybe, for example, β type titanium alloy such as 15Mo—5Zn—3Al titanium alloy, SP-700 titanium alloy, or marageing steel. The face body 12 is produced of a high strength plate-shape rolled metallic member.

The plate-like face body 12 is received in receipt portions designated by reference symbols 10T, 10TU, and 10S in FIG. 1, which are formed in the head body 10 as respective recesses in the shape of stepped portions having a depth corresponding to the thickness of the plate-like face body. The face body of welding using the laser-beam, which is applied, to the peripheries of the plate-like face body 12, designated by the reference symbols 12T, 12TU, 12S, and 12H in FIG. 1. Thus, a portion of the face body 12 positioned close to the periphery 12T on the side of the top of the iron head is received by the stepped receipt portion 10T of the head body 10 by allowing the rear face of such peripheral portion of the face body 12 to be seated on the receipt portion 10T. Similarly, a different portion of the face body 12 positioned close to the periphery 12TU on the side of the toe of the iron head is received by the stepped receipt portion 10TU of the head body 10 by sitting the rear face of the peripheral portion of the face body 12 onto the receipt portion 10TU. Further, a further different portion of the face body 12 positioned close to the periphery 12S on the side of the sole of the iron head is received by the stepped receipt portion 10S of the head body 10 by sitting the rear face of the peripheral portion of the face body 12 onto the receipt portion 10S.

It should be understood that the above-mentioned employment of the laser-beam welding method can provide technical advantages as set forth below, and is very effective for the iron head construction according to the present invention. Namely, in the case of the laser-beam welding method, no welding electrode is used, and accordingly, the welded portion could not usually be thickened, and thus it is possible to prevent the plate-like face body 12 from being inhibited from bending upon application of ball-hitting force to the iron head. Further, as the laser-beam welding has smaller thermal affection on the welded portions and other surrounding regions of the iron head, the lowering of the strength of such welded portions and the surrounding regions can be reduced. Also, any thermal deformation that might occur between the hosel and the face part of the iron head can be suppressed, and accordingly, the production quality of the iron head can be very stable.

However, with respect to a portion located adjacent to the periphery 12H of the face body 12 on the side of heel 10H, there is provided practically almost no receipt portion for the rear face of that portion. Namely, an almost entire portion of the periphery 12H on the heel side, which extends over a length denoted by "L" in FIG. 1, is provided with no receipt portion for permitting that portion to be seated thereon. Only two narrow portions denoted by "δ1" and "δ2" are received. In this connection, referring to FIG. 2, it will be understood that although the end face of the periphery of the face body 12 on the heel side is abutted against and welded to a confronting connecting face 10H" of the heel part 10H of the head body 10, almost no receipt portion is formed in the head body for receiving the rear face of the above-mentioned peripheral portion of the face body 12 on the heel side.

It should, however, be understood that receipt portions in places 10H' may be formed and provided in the head body so that some positions along the periphery extending over the length "L" maybe suitably received and supported. Nevertheless, the total length of these some receipt portions 10H' including the above-mentioned receipt portions "δ1" and "δ2" used for receiving the above-mentioned peripheral portion of the face body 12 extending over the length "L", on the heel side, should be at most equal to or smaller than one fourth of "L". Preferably, the total length should be equal to or smaller than one fifth of "L", and most preferably, no receipt portion for receiving the peripheral portion of the plate-like face body 12 on the heel side should be provided at all. It was experimentally confirmed that when the above-said total length is one fourth of "L", the face body 12 is able to exhibit a bending characteristic almost similar to that of the case where no receipt portion is provided, and accordingly, the power of the shots of the former case is also similar to the latter case.

As best shown in FIG. 2, a cavity BK is provided between the above-described plate-like face body 12 and a back part 10B of the head body 10. The provision of this cavity BK can bring about advantages as set forth hereinbelow. Namely, if it is assumed that the entire weight of the head body 10 is always designed to have a substantially constant value, it is possible to distribute metallic material, which should occupy that cavity BK, to other parts around the circumference of the iron head. Therefore, the stability of shots can be surely acquired. Also, appropriate bending characteristic of the plate-like face body 12 can be obtained so as to enhance the rebound performance of the iron head during shots. However, as described before, when receipt portions for receiving the peripheral portion of the face body 12 are provided, the bending characteristic of the peripheral portion of the plate-like face body 12 will be lowered. Thus, it is desired that the peripheral portion of the plate-like face body 12 on the side of the heel 10H, which has generally less bending characteristic, is almost not received by any receipt means, as described before, and further, the above-described cavity BK is formed to be extended to a position remote from the periphery 12H of the face body 12 on the heel side toward the heel of the head body. Namely, an extended cavity BK' as shown in FIG. 2 is provided. Thus, even when a golf ball GB is hit by a position of the iron head located close to the periphery 12H of the face body 12 on the heel side, the bending of the face body at that position easily occurs to thereby permit the ball GB to have a larger power.

At this stage, the position of the periphery 12H of the face body 12 on the heel side should preferably be such a specified position shown in FIG. 2 that the golf ball GB contacting both with the face part of the iron head and with either the heel part 10H or the lowermost portion of the hosel part of the iron head, is prevented from coming into direct contact with the periphery 12H to thereby protect the welded portion from being damaged when the iron head conducts shots.

Figure 3:
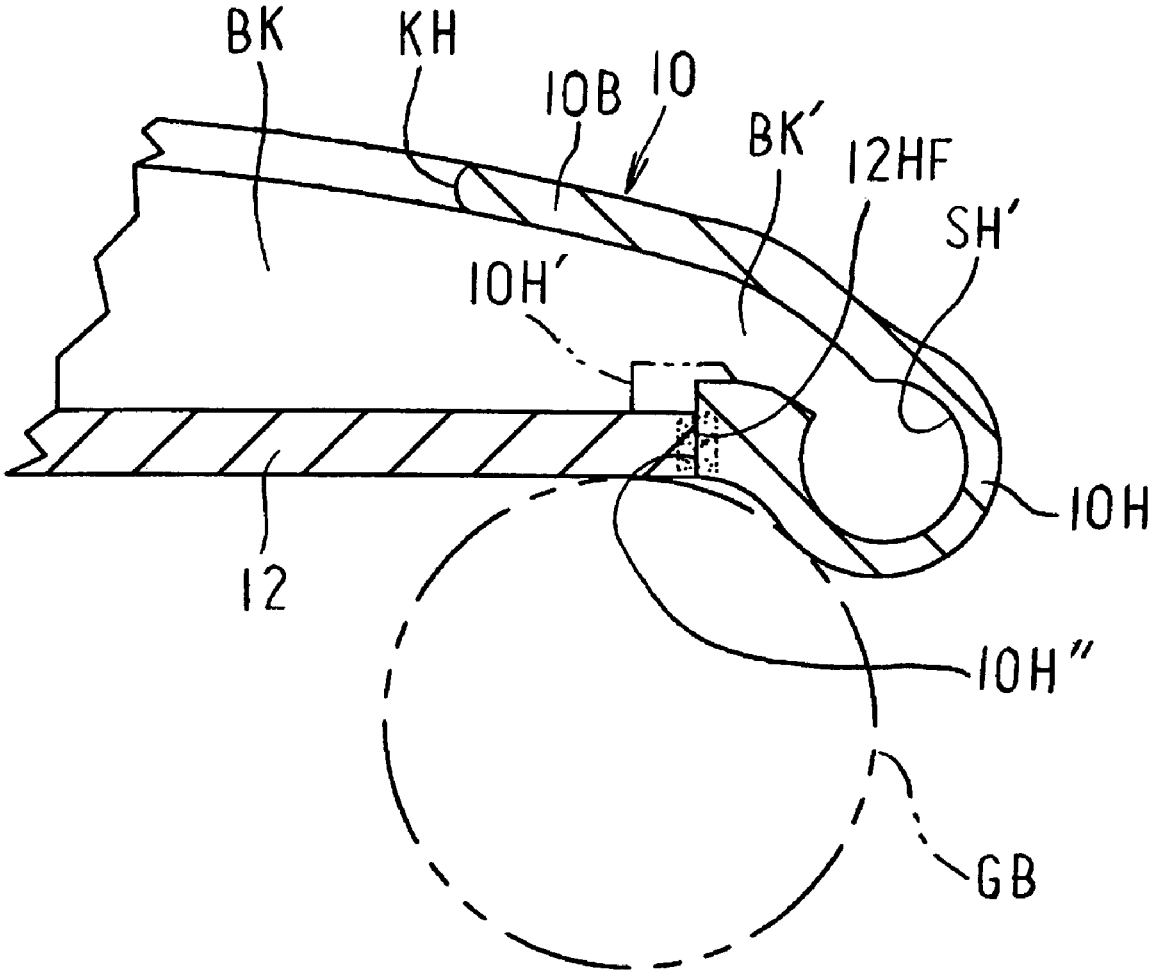
FIG. 3 is a partial cross-sectional view corresponding to FIG. 2 but illustrating another embodiment of the present invention; and, FIG. 4 is a view corresponding to FIG. 1 but illustrating a further embodiment of the present invention.

FIG. 3 illustrates a different embodiment of the arrangement and construction of the iron head provided with the face body 12 and the head body 10. It should, however, be noted that elements and portions of this embodiment that are the same as or similar to those shown in FIG. 2 are designated by the same reference symbols. As shown in FIG. 3, the extended cavity portion BK' is arranged so as to be fluidly communicated with a hole SH (not shown in FIG. 3) formed in the hosel part of the iron head or a hole portion SH' that is formed as an extension of the hole SH. Such fluid communication between the extended cavity portion BK' and the hole SH in the hosel part can provide several advantages similar to those obtained from the arrangement of the afore-mentioned cavity BK. Namely, the metallic material removed from the extended cavity and hole portions BK' and SH' might be distributed to other portions of the iron head so that the sweet area may be increased. Further, removal of the metallic material from the extended cavity and hole portions BK' and SH' may contribute to reduction in the entire weight of the iron head as required.

If preferably, the back part 10B of the head body may be provided with a through-hole KH, which permits the cavity BK to be communicated with the external atmosphere.

Figure 4:
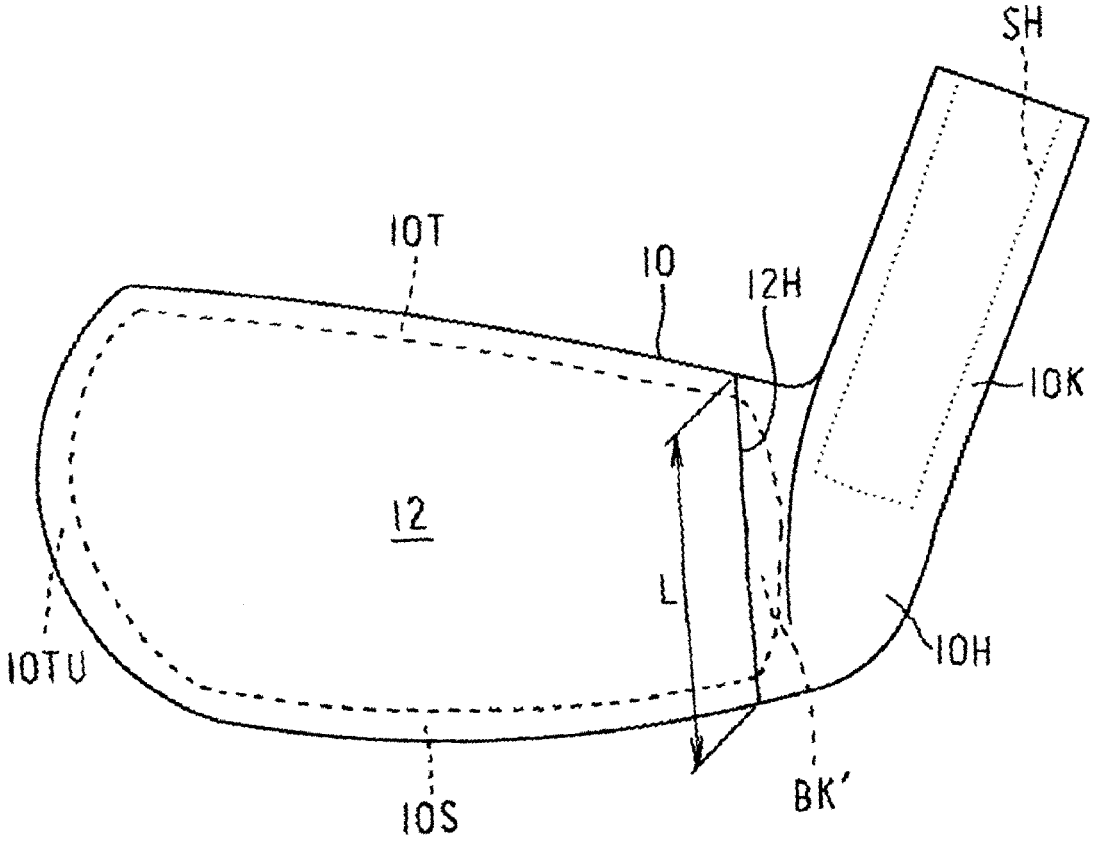

In a further different embodiment shown in FIG. 4, the plate-like face body 12 is formed and sized so as to extend over substantially the entire vertical width of the head body 12.

Referring again to FIG. 2, when the plate-like face body 12 is made of marageing steel and when the head body 10 is made of seventeen-four stainless steel, if the thickness T1 of the former 12 is set to be 1.5 through 2.8 mm thick, the specified portion of the heel part of the head body, the face 10H" of which confronts and is abutted against the end face 12HF of the periphery of the face body on the heel side, should have the thickness T2 that is slightly larger than the thickness T1 of the face body 12. More specifically, the thickness T2 should be approximately 0.2 through 1.0 mm larger than the thickness T1, i.e., the thickness T2 should preferably be selected to be approximately 1.7 through 3.8 mm. This is because the strength of the material of the head body 10 is inferior to that of the material of the face body 12. Nevertheless, the thickness T1 and the thickness T2 might be equal to each other as required.

Of course, it will be understood that the described and illustrated construction and arrangement of respective embodiments might be mutually incorporated or combined so long as some advantages can be enjoyed due to such incorporation or combination.

Although several embodiments of the present invention have been described, it will be understood that in accordance with the present invention, an iron head for a golf club having a possible best rebound property even when shots occur at a position adjacent to periphery of the plate-like face body on the side of the heel, can be provided. Many modifications and variations will occur to a person skilled in the art without departing from the scope and spirit of the invention as set forth in the accompanying claims.

What is claim is:

1. An iron head for a golf club including a head body made of a metal and having a hosel part, and a plate-like face body welded to the head body and made of a metallic material different from the metal of the head body, the plate-like face body having first through fourth peripheries arranged adjacent to toe, heel, top, and sole portions of said head body respectively, comprising:

a cavity portion between said plate-like face body and a back part of said head body, said cavity portion being defined so as to extend in said head body from a first position adjacent the toe portion of said head body to a second position adjacent to a heel portion of said head body, sand second position being remote from said secondary periphery in a direction toward said heel portion of said head body, said head body having a receipt portion thereof provided for receiving a rear face portion of said plate-like face body adjacent to said second periphery, said receipt portion having a length equal to or less than one fourth of a length of said second periphery, said second periphery being positioned in a specified position wherein a golf ball is prevented from coming into direct contact with said second periphery even when said golf ball is sized such that said golf ball is in contact with both a surface of said hosel part and a surface of said plate-like face body apart from said second periphery simultaneously.

2. An iron head as set forth in claim 1, wherein said plate-like face body is made of a metallic rolled plate, which has a higher strength than that of a metal of which said head body is made.

3. An iron head as set forth in claim 2, wherein said metallic rolled plate of said higher strength is made of a β type titanium alloy or a marageing steel.

4. An iron head as set forth in claim 1, wherein said plate-like face body and said head body are connected together by welding using laser-beam.

5. An iron head as set forth in claim 1, wherein said cavity portion extending between a rear face of said plate-like face body and a back part of said head body is formed to be fluidly communicated with a shaft receipt hole provided in said hosel part of said iron head.

6. An iron head as set forth in claim 1, wherein said plate-like face body is arranged to extend over the entire width of said head body in a vertical direction.

7. An iron head as set forth in claim 1, wherein a thickness of the heel part of said head body at its portion confronting an end face of said periphery of said plate-like face body on the heel side is made larger than that of said face body.

8. An iron head as set forth in claim 7, wherein said plate-like face body is made of marageing steel, and said head body is made of seventeen-four stainless steel containing 17% chromium, 4% nickel, 4% copper, and 1% niobium.

9. An iron head as set forth in claim 8, wherein the thickness of said portion of said heel part is made approximately 0.2 through 1 mm larger than that of said plate-like face body.

10. An iron head for a golf club including a head body made of a metal having a hosel part, and a plate-like face body welded to the head body and made of a metallic material different from the metal of the head body, comprising a cavity portion between said plate-like face body and a back part of said head body, said cavity portion being defined so as to extend to a position remote from a periphery of said plate-like face body located on the side of a heel of said head body, wherein said periphery is positioned such that a golf ball is prevented from contacting said periphery when a golf ball is sized such that said golf ball is in contact with both a surface of said hosel part and a surface of said plate-like face body simultaneously, and wherein said cavity portion extending between a rear face of said plate-like face body and back part of said head body is formed to be fluidly communicated with shaft receipt hole provided in said hosel part of said iron head.

11. An iron head as set forth in claim 10, wherein said plate-like face body is made of a metallic rolled plate, which has a higher strength than that of a metal of which said head body is made.

12. An iron head as set forth in claim 11, wherein said metallic rolled plate of said higher strength is made of a β type titanium alloy or a marageing steel.

13. An iron head as set forth in claim 10, wherein said plate-like face body and said head body are connected together by welding using laser-beam.

14. An iron head as set forth in claim 10, wherein said plate-like face body is arranged to extend over the entire width of said head body in a vertical direction.

15. An iron head as set forth in claim 10, wherein a thickness of the heel part of said head body at its portion confronting an end face of said periphery of said plate-like face body on the heel side is made larger than that of said face body.

16. An iron head as set forth in claim 15, wherein said plate-like face body is made of marageing steel, and said head body is made of seventeen-four stainless steel containing 17% chromium, 4% nickel, 4% copper, and 1% niobium.

17. A golf club head comprising:

a head body made of metal;

a hosel part; and a plate-like face body made of a metallic material different from the metal of the head body, wherein one periphery of the plate-like face body adjacent the hosel part is positioned such that a golf ball is prevented from contacting the one periphery when the golf ball is sized such that the golf ball is in contact with both a surface of the hosel part and a surface of the plate-like face body simultaneously, and the plate-like face body defines a cavity portion with the head body, the cavity portion extending beyond a vertical edge of the plate-like face body adjacent to the hosel part.

18. A golf club head according to claim 17, wherein the head body has a receiving portion adjacent to the vertical edge of the plate-like face body, and the receiving portion has a length less than about one fourth of the length of the edge of the plate-like face body.

19. A golf club head according to claim 17, wherein a through-hole within a back part of the head body extends into the cavity portion.

* * * * *

UNITED STATES PATENT AND TRADEMARK OFFICE

CERTIFICATE OF CORRECTION

PATENT NO. : 7,115,048 B2
APPLICATION NO. : 10/664445
DATED : October 3, 2006
INVENTOR(S) : Kusumoto et al.

It is certified that error appears in the above-identified patent and that said Letters Patent is hereby corrected as shown below:

Column 6, Line 58, please insert --to-- between “adjacent” and “the”

Column 6, Line 60, please delete “sand” and replace with --said--

Column 7, Line 40-41, please insert --:-- after “comprising”

Column 8, Line 28, please insert --,-- after “head”

Column 8, Line 33, please insert --to-- between “adjacent” and “the”

Signed and Sealed this

Sixteenth Day of January, 2007

JON W. DUDAS
*Director of the United States Patent and Trademark Office*